US005429210A

United States Patent [19]

Hansen

[11] Patent Number: 5,429,210

[45] Date of Patent: Jul. 4, 1995

[54] ADJUSTABLE HEIGHT WAGON

[76] Inventor: Elmer K. Hansen, deceased, late of Pahrump, Nev.; by Catherine Hansen, executor, Box 70244, Pahrump, Nev. 89041

[21] Appl. No.: 184,671

[22] Filed: Jan. 21, 1994

[51] Int. Cl.[6] ..... B66B 9/16

[52] U.S. Cl. ..... 187/243; 187/269

[58] Field of Search ..... 187/9 R, 18, 240, 243, 187/244, 269

[56] References Cited

U.S. PATENT DOCUMENTS

| | | | |
|---|---|---|---|
| Re. 27,914 | 2/1974 | King | 187/18 X |
| 2,617,547 | 11/1952 | Pridy | 187/18 X |
| 3,628,771 | 12/1971 | Egeland et al. | 187/18 X |
| 4,405,116 | 9/1983 | Eisenberg | 187/18 X |
| 4,549,720 | 10/1985 | Bergenwall | 187/18 X |
| 4,969,793 | 11/1990 | Pawl | 187/18 X |

*Primary Examiner*—David H. Bollinger
*Assistant Examiner*—Dean A. Reichard
*Attorney, Agent, or Firm*—Brian J. Laurenzo; Kent A. Herink

[57] ABSTRACT

An adjustable height wagon capable of being manipulated between an orientation allowing maximum lift and an orientation allowing maximum height. The provision of a lift mechanism below an undercarriage of the wagon increases the stability of the wagon during lifting, and allows a material supporting bed to be drawn into contact with the undercarriage, thereby increasing the stability of both the material supporting bed and the wagon.

27 Claims, 5 Drawing Sheets

ADJUSTABLE HEIGHT WAGON

BACKGROUND OF THE INVENTION

The present invention relates generally to an adjustable height wagon and, more particularly, to a scissors-type wagon which may alternatively be set for low, high-power lifting or for high, low-power lifting.

Adjustable height wagons are well-known in the prior art and lave been adapted to agricultural use for centuries. The lifting mechanism of most prior art adjustable height wagons is very heavy and tends to unbalance the wagon as the lifting bed is raised or the wagon is drawn around corners. The use of a lifting device which adds to, rather than detracts from, the stability of the wagon is accordingly desirable.

An additional problem associated with prior art adjustable height wagons is the inability to provide a wagon which is possessed with a heavy lifting capability as well as a high lifting capability. Adjustable height wagons are available with a large weight lifting capability, but these types of wagons typically do not have a high lifting capability. Similarly, adjustable height wagons are available with desirable height characteristics, but these wagons are underpowered for heavy lifting. It is accordingly desirable to provide an adjustable height wagon capable of alternately accommodating heavy lifting jobs and high lifting jobs.

Difficulties encountered in the prior art discussed hereinabove are substantially eliminated by the present invention.

SUMMARY OF THE INVENTION

Accordingly, it is an object of the present invention to provide an adjustable height wagon for lifting large loads.

A further object of the present invention is to provide an adjustable height wagon for lifting articles requiring a high vertical lift.

Another object of the present invention is to provide an adjustable height wagon having stable lifting attributes.

Still another object of the present invention is to provide an adjustable height wagon which maintains stability as it moves over the ground.

Other objects of the present invention will become apparent upon reference to the following specification, drawings, and claims.

By the present invention, it is proposed to overcome difficulties encountered heretofore. To this end, an adjustable height wagon is provided for transporting and lifting material. The wagon is provided with a substantially horizontal upper portion capable of fully collapsing toward a lower portion of the adjustable height wagon for stability of the substantially horizontal upper portion of the adjustable height wagon during transportation of the material.

A material supporting bed is provided and is capable of being positioned in a substantially horizontal position for support and transport of material. An undercarriage capable of supporting the material supporting bed during operation transportation and storage of the adjustable height wagon is also provided. The adjustable height wagon has a first arm having a first end, a second end, and a center portion, wherein the first end of the first arm is operably and pivotally secured to the undercarriage and wherein the second end of the first arm is operably and slidably coupled to the material supporting bed in supporting engagement thereof.

The adjustable height wagon has a second arm having a first end, a second end, and a center portion, wherein the first end of the second arm is operably and pivotally secured to the material supporting bed for supporting engagement thereof, the second end of the second arm is operably and slidably coupled to the undercarriage, and the center portion of the second arm is operably and pivotally connected to the center portion of the first arm. Operably connected to the second arm are means for moving the second end of the second arm relative to the first end of the first arm.

Preferably, the adjustable height wagon is provided with means for adjusting tile operable and pivotal connection of the center portion of the second arm to the center portion of the first arm to manipulate the extension height and lifting capacity of the adjustable height wagon.

DETAILED DESCRIPTION OF THE INVENTION

Figure 1:
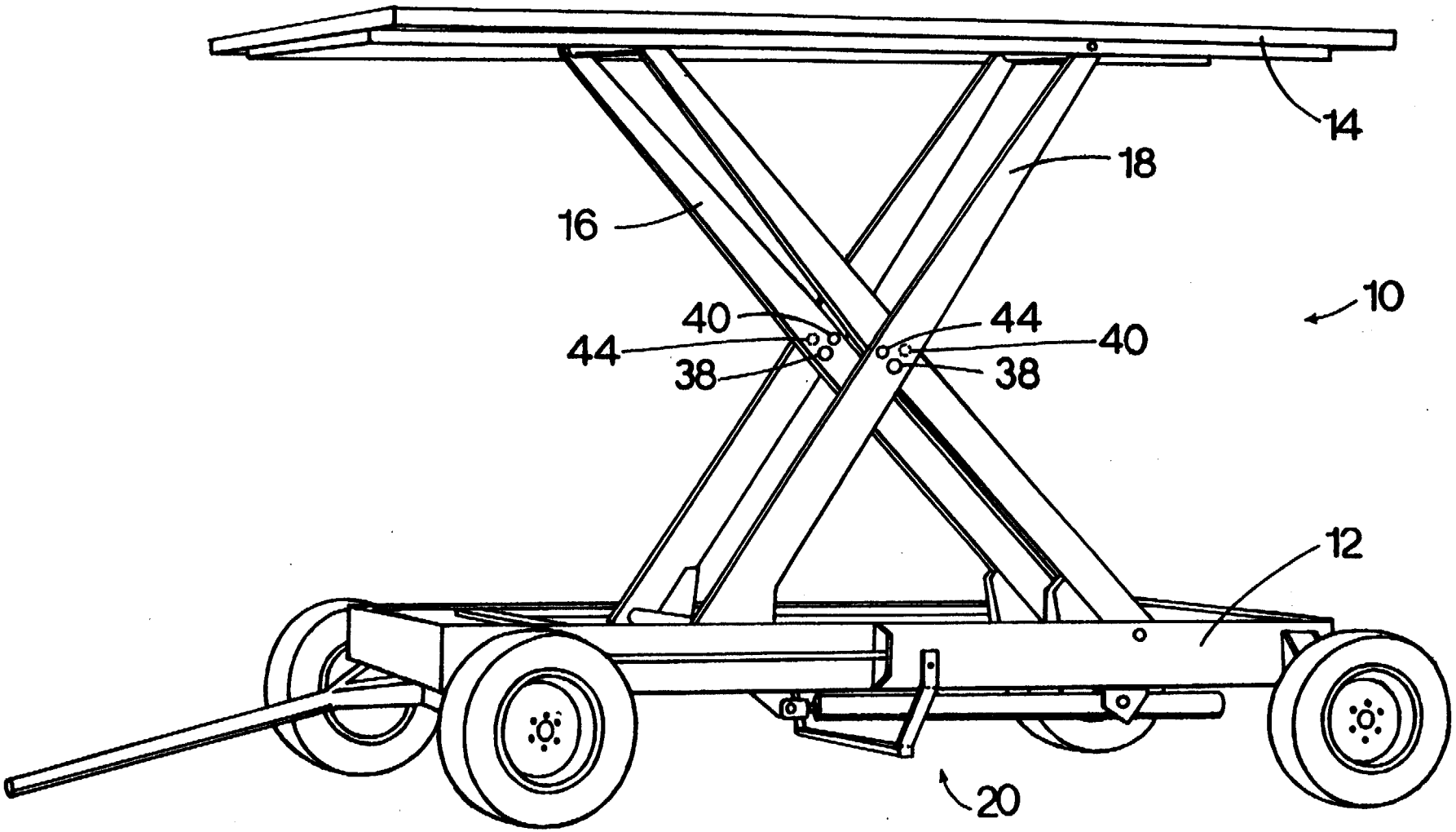
FIG. 1 is a perspective view of the present invention showing the material supporting bed in the full extension of the first pivot position.

In the Figures, an adjustable height wagon 10 for lifting material is illustrated, wherein an undercarriage 12 is operably connected to a material supporting bed 14 by a first pair of arms 16 and a second pair of arms 18 (FIG. 1). The arms 16 and 18 are pivotally connected to one another and are moved in relationship to one another by a lift mechanism 20 used to raise and lower the material supporting bed 14.

Figure 4:
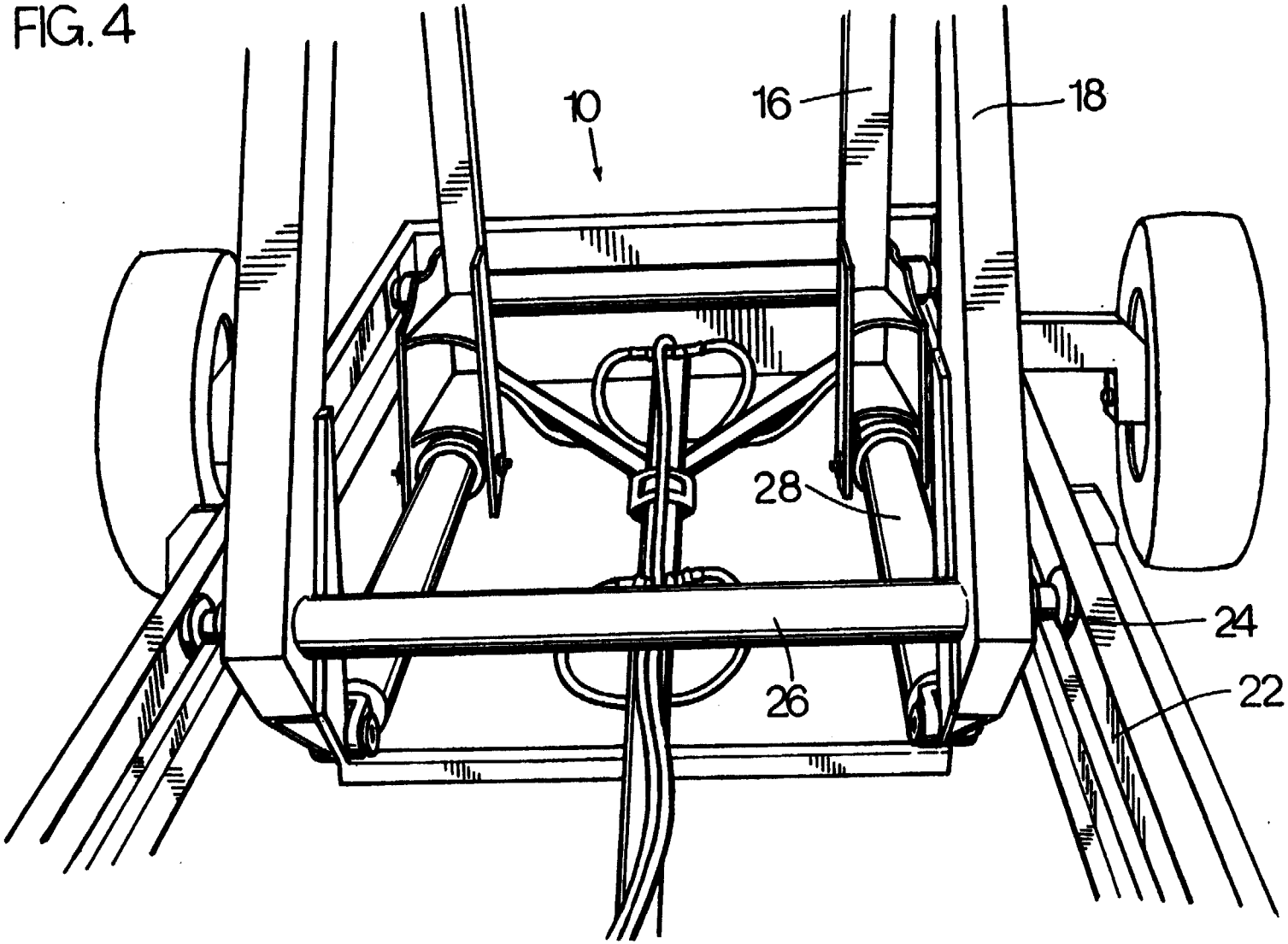
FIG. 4 is a perspective view showing the undercarriage and lift mechanism of the present invention.

FIG. 1 shows the adjustable height wagon 10 in an extended position with the material supporting bed 14 lifted well above the undercarriage 12. The first pair of arms 16 are pivotally secured to the undercarriage 12 as shown in FIG. 4. The undercarriage 12 is provided with a pair of tracks 22. A pair of wheels 24 journaled to an arm support 26 ride within these tracks 22. The arm support 26 is secured to the second pair of arms 18 by weldments or similar securement means.

Figure 5:
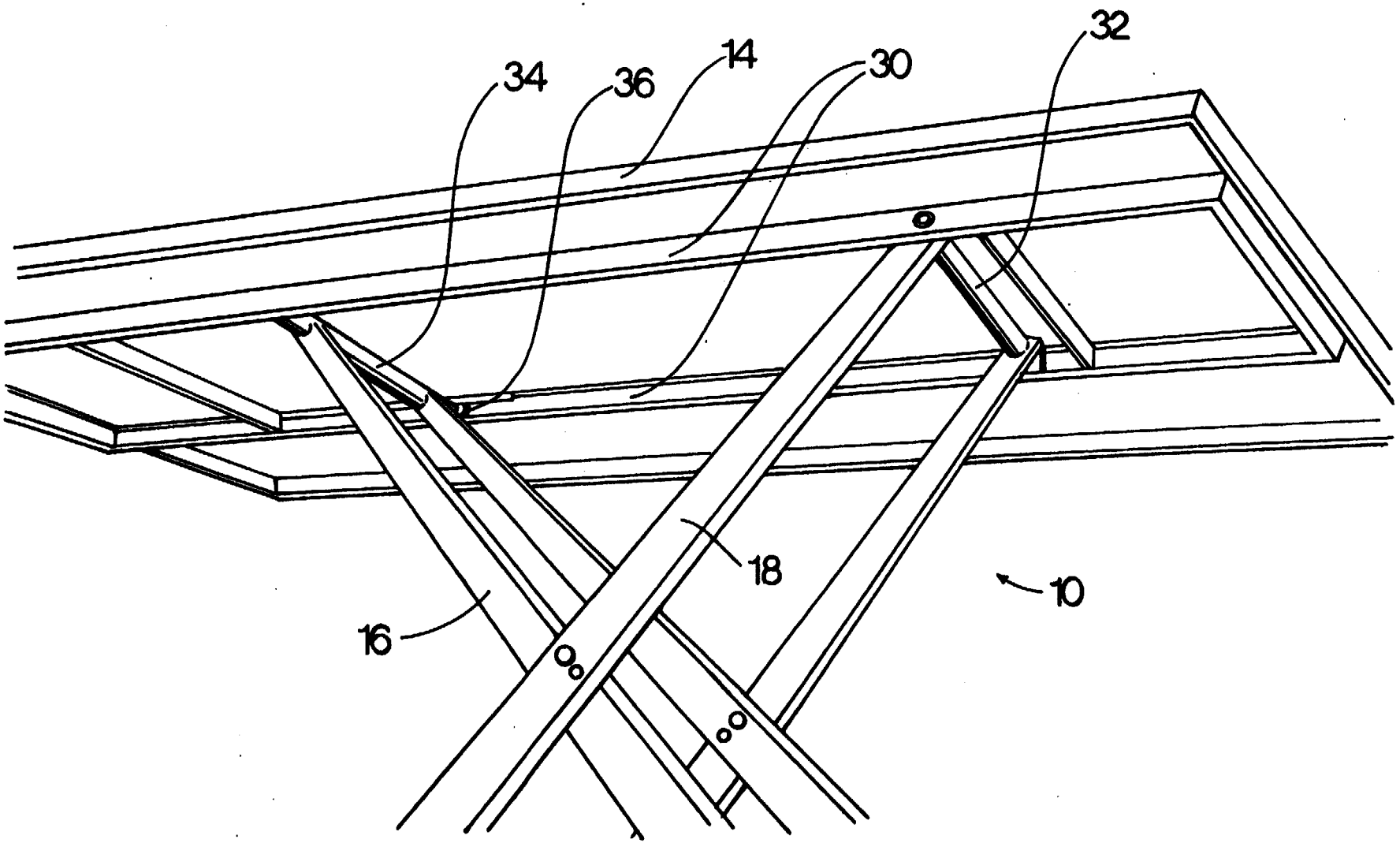
FIG. 5 is a perspective view showing the arms coupled to the material supporting bed.

Pivotally secured between the first pair of arms 16 and the second pair of arms 18 are a pair of hydraulic pistons 28 (FIG. 4). The pistons 28 are preferably located below the undercarriage 12 to lower the center of gravity of the adjustable height wagon 10. As shown in FIG. 5, the material supporting bed 14 is provided with a pair of tracks 30 to which the second pair of arms 18 is pivotally secured. Secured between the second pair of arms 18 is a brace 32 used to separate and support the second pair of arms 18. A similar brace 34 is secured between the first pair of arms 16. Additionally, a pair of wheels 36 are journaled to the ends of the brace 34. The wheels 36 are provided in the tracks 30 and move along the tracks 30 as the material supporting bed 14 is moved upward and downward.

Figure 2:
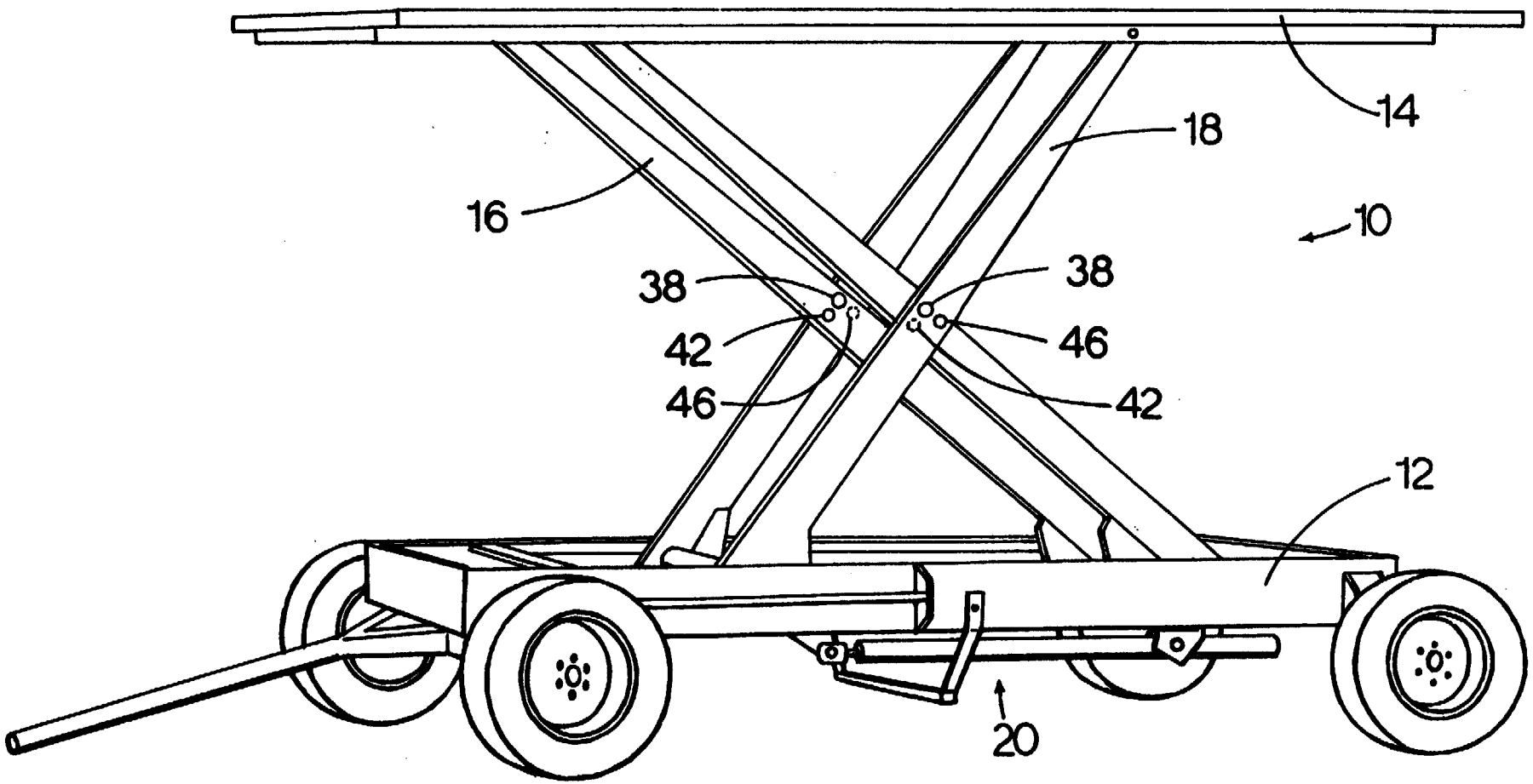
FIG. 2 is a perspective view of the present invention showing the material supporting bed in the full extension of the second pivot position.
Figure 3:
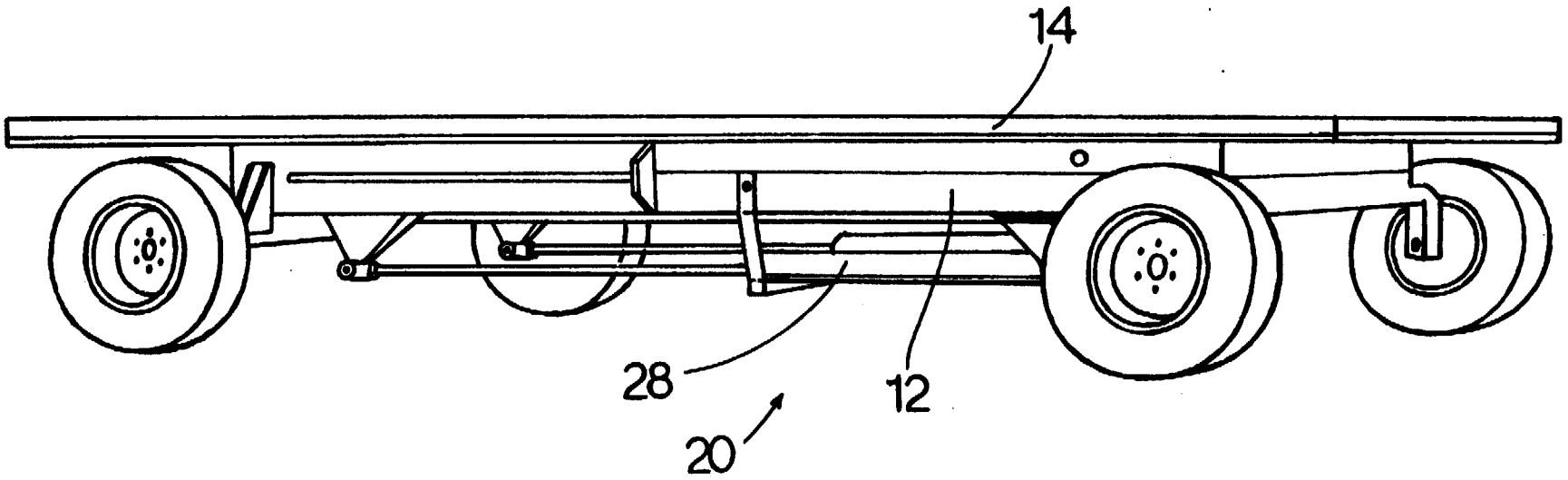
FIG. 3 is a perspective view showing the material supporting bed in the lowered position.

As shown in FIGS. 1 and 2, the first pair of arms 16 are pivotally connected to the second pair of arms 18 by a pair of pins 38. The first pair of arms 16 are provided with upper holes 40 and lower holes 42 designed to receive the pins 38 (FIGS. 1 and 2). Similarly, the second pair of arms 18 are provided with upper holes 44 and lower holes 46 for receipt of the pins 38. Preferably, the holes 40, 42, 44, and 46 are placed midway between the ends of the arms 16 and 18 and are located generally along a line perpendicular to the length of the arms 16 and 18.

To operate the wagon 10, the pins 38 are placed either through the upper holes 40 and 44 of the first and second pairs of arms 16 and 18, or through the lower holes 42 and 46 (FIGS. 1-2). If it is desired to lift a heavy load a short distance, it is desirable to place tile pins 38 through the upper holes 40 and 44. By placing the pins 38 through the upper holes 40 and 44, the point at which the first pair of arms 16 and second pair of arms 18 pivot in relationship to one another is lowered. By lowering the pivot point between the first pair of arms 16 and the second pair of arms 18, the leverage of the two pairs of arms 16 and 18 is increased, thereby allowing the lift mechanism 20 to lift a heavier load placed upon the material supporting bed 14.

If, it is desired to raise the material supporting bed 14 higher than the maximum point achievable with the pins 38 in the upper holes 40 and 44, the pins may be moved to the lower holes 42 and 46 (FIGS. 1-2). By moving the pins 38 in this manner, the pivot point between the first pair of arms 16 and the second pair of arms 18 is raised. The maximum height achievable for the material supporting bed 14 in relationship to the undercarriage 12 is thereby raised. By manipulating the pins 38, the wagon 10 may be set up for very high lifting or very heavy lifting, depending on the required task.

By placing the lift mechanism 20 below the undercarriage 12, the arms 16 and 18 have sufficient room to fully retract. The material supporting bed 14, therefore, can then come into contact with the undercarriage 12 when retracted. The material supporting bed 14 is thereby supported by the undercarriage 12 which provides greater strength and a more stable support than that provided by the arms 16 and 18 alone. This added strength and stability aids in the support of heavy loads and in transportation of goods. The placement of the lift mechanism 20 below the undercarriage 12 also adds stability to the entire wagon 10 in both the raised and lowered orientations of the wagon 10. The placement of the lift mechanism 10 lowers the center of gravity of the wagon 10, not only affording the wagon 10 stable lifting attributes, but also stabilizing the wagon 10 as it is pulled.

The foregoing description and drawings merely explain and illustrate the invention and the invention is not limited thereto, except insofar as the claims are so limited, as those skilled in the art who have the disclosure before them will be able to make modifications and variations therein without departing from the scope of the invention. For example, it is contemplated that numerous holes may be placed along the first pair of arms 16 and second pair of arms 18 to vary the lifting capability of the wagon 10 over a broader range of heights and loads.

What is claimed is:

1. An adjustable height wagon for transporting and lifting material in which a substantially horizontal portion of the adjustable height wagon is capable of collapsing toward a lower portion of the adjustable height wagon for stability of the substantially horizontal portion of the adjustable height wagon during transportation of the material, said adjustable height wagon comprising:

a. a substantially horizontal material supporting bed capable of supporting the material;

b. an undercarriage having a top and capable of supporting said material supporting bed during operation, transport, and storage of the adjustable height wagon;

c. a first arm having a first end, a second end, and a center portion, wherein said first end of said first arm is operably and pivotally secured to said undercarriage and wherein said second end of said first arm is operably and slidably coupled to said material supporting bed, in supporting engagement thereof;

d. a second arm having a first end, a second end, and a center portion, wherein said first end of said second arm is operably and pivotally secured to said material supporting bed, in supporting engagement thereof, wherein said second end of said second arm is operably and slidably coupled to said undercarriage, and wherein said center portion of said second arm is operably and pivotally connected to said center portion of said first arm; and e. means for manipulating the extension height and lifting capacity of the adjustable height wagon comprising means for adjusting said operable and pivotal connection of said center portion of said second arm to said center portion of said first arm.

2. The adjustable height wagon of claim 1, wherein said moving means is positioned below said undercarriage.

3. The adjustable height wagon of claim 1, further comprising means for collapsing the adjustable height wagon from an extended position to a collapsed position with said material supporting bed in contact with, and directly supported by, said undercarriage.

4. The adjustable height wagon of claim 1, further comprising a second set of arms operably connected between said material supporting bed and said undercarriage in substantially the same manner as said first arm and said second arm are connected between said material supporting bed and said undercarriage.

5. The adjustable height wagon of claim 4, wherein said second set of arms are operably connected to said first arm and said second arm.

6. The adjustable height wagon of claim 1, wherein said moving means is a hydraulic linear actuator, pivotally connected to said second end of said second arm.

7. The adjustable height wagon of claim 1, further comprising an upper track operably secured to said material supporting bed and slidably coupled to said second end of said first arm.

8. The adjustable height wagon of claim 1, further comprising a lower track operably secured to said undercarriage and slidably coupled to said second end of said second arm.

9. The adjustable height wagon of claim 1, wherein said adjusting means is a pin capable of being moved from a first pivot position within a first set of holes provided in said center portion of said first arm and said center portion of said second arm, to a second pivot position within a second set of holes provided in said center portion of said first arm and said center portion of said second arm.

10. An adjustable height wagon for transporting and lifting material in which a substantially horizontal portion of the adjustable height wagon is capable of fully collapsing toward a lower portion of the adjustable height wagon for stability of the substantially horizontal portion of the adjustable height wagon during transportation of the material, said adjustable height wagon comprising:

a. a substantially horizontal material supporting bed capable of supporting the material;

b. an undercarriage capable of supporting said material supporting bed during operation, transport, and storage of the adjustable height wagon;

c. a first arm having a center portion provided with a low pivot point and a high pivot point, said first arm also having a first end and a second end, wherein said first end of said first arm is operably and pivotally secured to said undercarriage and wherein said second end of said first arm is operably and slidably coupled to said material supporting bed, in supporting engagement thereof;

d. a second arm having a center portion provided with a low pivot point and a high pivot point, said second arm also having a first end and a second end, wherein said first end of said second arm is operably and pivotally secured to said material supporting bed, in supporting engagement thereof, and wherein said second end of said second arm is operably and slidably coupled to said undercarriage;

e. wherein said center portion of said first arm is positioned across and pivotally connected to said center portion of said second arm in such a manner that said first arm pivots about a common axis with said second arm;

f. means for alternatively connecting said high pivot point of said first arm to said high pivot point of said second arm and connecting said low pivot point of said first arm to said low pivot point of said second arm; and g. means operably connected to said second end of said second arm for moving said second end of said second arm relative to said first end of said first arm.

11. The adjustable height wagon of claim 10, wherein said alternative connection means is a pin, wherein said first arm is provided with a first hole capable of receiving said pin at said high pivot point of said first arm, wherein said second arm is provided with a first hole capable of receiving said pin at said high pivot point of said second arm, wherein said first arm is provided with a second hole capable of receiving said pin at said low pivot point of said first arm, and wherein said second arm is provided with a second hole capable of receiving said pin at said low pivot point of said second arm.

12. The adjustable height wagon of claim 10, wherein said undercarriage is provided with a top portion which is positioned above said moving means.

13. The adjustable height wagon of claim 10, wherein said moving means is positioned below said undercarriage.

14. The adjustable height wagon of claim 10, further comprising means for collapsing the adjustable height wagon from an extended position to a collapsed position with said material supporting bed in contact with, and supported by, said undercarriage.

15. The adjustable height wagon of claim 10, further comprising a second set of arms operably connected between said material supporting bed and said undercarriage in substantially the same manner as said first arm and said second arm are connected between said material supporting bed and said undercarriage.

16. The adjustable height wagon of claim 10, wherein said second set of arms are operably connected to said first arm and said second arm.

17. The adjustable height wagon of claim 10, wherein said moving means is a hydraulic linear actuator, pivotally connected to said second end of said second arm.

18. The adjustable height wagon of claim 10, further comprising an upper track operably secured to said material supporting bed and slidably coupled to said second end of said first arm.

19. The adjustable height wagon of claim 10, further comprising a lower track operably secured to said undercarriage and slidably coupled to said second end of said second arm.

20. A scissor-lift wagon for transporting and lifting material in which a substantially horizontal portion of the scissor-lift wagon is capable of fully collapsing toward a lower portion of the scissor-lift wagon for stability of the substantially horizontal portion of the scissor-lift wagon during transportation of the material, said scissor-lift wagon comprising:

a. a substantially horizontal material supporting bed capable of supporting the material;

b. an undercarriage capable of supporting said material supporting bed during operation, transport, and storage of the adjustable height wagon;

c. a first arm having a first end, a second end, and a center portion, wherein said first end of said first arm is operably and pivotally secured to said undercarriage and wherein said second end of said first arm is operably and slidably coupled to said material supporting bed, in supporting engagement thereof;

d. a second arm having a first end, a second end, and a center portion, wherein said first end of said second arm is operably and pivotally secured to said material supporting bed, in supporting engagement thereof, wherein said second end of said second arm is operably and slidably coupled to said undercarriage, and wherein said center portion of said second arm is operably and pivotally connected to said center portion of said first arm;

e. means for adjusting said operable and pivotal connection of said center portion of said second arm to said center portion of said first arm from a low pivot point to a high pivot point; and f. means positioned below said undercarriage and operably connected to said second end of said second arm for moving said second end of said second arm relative to said first end of said first arm.

21. The adjustable height wagon of claim 20, wherein said moving means is a hydraulic linear actuator, pivotally connected to said second end of said second arm.

22. The adjustable height wagon of claim 20, further comprising means for collapsing the adjustable height wagon from an extended position to a collapsed position with said material supporting bed in contact with, and directly supported by, said undercarriage.

23. The adjustable height wagon of claim 20, further comprising a second set of arms operably connected between said material supporting bed and said undercarriage in substantially the same manner as said first arm and said second arm are connected between said material supporting bed and said undercarriage.

24. The adjustable height wagon of claim 20, wherein said second set of arms are operably connected to said first arm and said second arm.

25. The adjustable height wagon of claim 20, further comprising an upper track operably secured to said material supporting bed and slidably coupled to said second end of said first arm.

26. The adjustable height wagon of claim 20, further comprising a lower track operably secured to said undercarriage and slidably coupled to said second end of said second arm.

27. The adjustable height wagon of claim 20, wherein said adjusting means is a pin capable of being moved from a first pivot position within a first set of holes provided in said center portion of said first arm and said center portion of said second arm to a second pivot position within a second set of holes provided in said center portion of said first arm and said center portion of said second arm.

* * * * *